US007537321B2

(12) United States Patent
Mita

(10) Patent No.: US 7,537,321 B2
(45) Date of Patent: May 26, 2009

(54) DROPLET DISCHARGE HEAD AND MANUFACTURING METHOD THEREOF

(75) Inventor: Tsuyoshi Mita, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 577 days.

(21) Appl. No.: 10/973,243

(22) Filed: Oct. 27, 2004

(65) Prior Publication Data

US 2005/0088492 A1 Apr. 28, 2005

(30) Foreign Application Priority Data

Oct. 28, 2003 (JP) ..... 2003-367019

(51) Int. Cl.
*B41J 2/045* (2006.01)

(52) U.S. Cl. ..... 347/72

(58) Field of Classification Search ..... 347/71–72, 347/68; 29/25.35; 310/311
See application file for complete search history.

(56) References Cited

U.S. PATENT DOCUMENTS

| | | | | |
|---|---|---|---|---|
| 4,409,135 | A | 10/1983 | Akimune et al. | |
| 5,128,694 | A * | 7/1992 | Kanayama | 347/72 |
| 6,345,887 | B1 * | 2/2002 | Sato | 347/72 |
| 2001/0002136 | A1 * | 5/2001 | Usui et al. | 347/72 |
| 2003/0085307 | A1 | 5/2003 | Okuda et al. | |
| 2003/0098632 | A1 * | 5/2003 | Takeuchi et al. | 310/328 |
| 2003/0112298 | A1 * | 6/2003 | Sato et al. | 347/68 |

FOREIGN PATENT DOCUMENTS

| | | | |
|---|---|---|---|
| JP | 04-371846 | A | 12/1992 |
| JP | 8-11304 | A | 1/1996 |
| JP | 09-039238 | A | 2/1997 |
| JP | 10-109411 | A | 4/1998 |
| JP | 10-272776 | A | 10/1998 |
| JP | 11-157074 | A | 6/1999 |
| JP | 2002-208657 | A | 7/2002 |
| JP | 2002-254657 | A | 9/2002 |
| JP | 2003-1823 | A | 1/2003 |
| JP | 2003-068920 | A | 3/2003 |
| JP | 2003-69103 | A | 3/2003 |
| JP | 2003-226007 | A | 8/2003 |
| WO | WO-95/10416 | A1 | 4/1995 |

* cited by examiner

*Primary Examiner*—Manish S. Shah
*Assistant Examiner*—Lisa M Solomon
(74) *Attorney, Agent, or Firm*—Birch, Stewart, Kolasch & Birch, LLP

(57) ABSTRACT

The droplet discharge head comprises: a plurality of nozzles which discharge droplets of liquid; a plurality of pressure chambers which are connected to the nozzles and filled with the liquid to be discharged through the nozzles; and a laminated piezoelectric body which has a plurality of active portions to impart pressure variation to the liquid inside the pressure chambers so as to cause the droplets to be discharged from the nozzles, respectively, wherein first linear grooves and second linear grooves which intersect each other at a prescribed non-orthogonal angle are formed in the laminated piezoelectric body, and the active portions of the laminated piezoelectric body are defined by the first and second linear grooves.

12 Claims, 11 Drawing Sheets

186
172A
172B
186
OVERLAY PLURALITY OF LAYERS 180A
190A
190B
180B 154
156
172A(180A)
172B
(180B)

154
156
156

DROPLET DISCHARGE HEAD AND MANUFACTURING METHOD THEREOF

This Nonprovisional application claims priority under 35 U.S.C. § 119(a) on patent application Ser. No(s). 2003-367019 filed in Japan on Oct. 28, 2003, the entire contents of which are hereby incorporated by reference.

BACKGROUND OF THE INVENTION

1. Field of the Invention

The present invention relates to a droplet discharge head and a manufacturing method thereof, and more specifically to a structure for a piezoelectrically driven droplet discharge head for varying the volume of the pressure chamber using a laminated piezoelectric body to discharge droplets from a nozzle, and a manufacturing method thereof.

2. Description of the Related Art

Japanese Patent Application Publication No. 8-011304 discloses an inkjet head using a laminated piezoelectric body, which is formed by alternately laminating piezoelectric material and electrodes. The inkjet head has a structure in which a laminated piezoelectric body has two or more rows of pectinate shapes formed by half-cut grooves, and the position of each divided tip thereof is joined in accordance with the position of the pressure chamber. The inkjet head also has a structure in which a laminated piezoelectric body partitioned by grooves is arrayed in the form of a matrix, and a higher density of nozzles in a single row is achieved with two rows of piezoelectric elements. It is doubtful that this structure can be constructed with three or more rows of piezoelectric elements, and it is possible that a structure in which a nozzle row with a single color is constructed with two rows of piezoelectric elements is envisioned in the publication.

Moreover, in Japanese Patent Application Publication No. 8-011304, the pectinate portions partitioned in the form of teeth of a comb by the groves are all active portions (portions by which pressure is generated for varying the volumes of the pressure chambers), and there are no partition walls corresponding to the shape of the pressure chambers, so there is concern that undesirable crosstalk may occur when an adjacent pressure chamber is driven.

Furthermore, when the pectinate laminated piezoelectric body disclosed in Japanese Patent Application Publication No. 8-011304 is joined to a long head, the mechanical strength of the piezoelectric body is low with respect to stress produced by bonding or heat during the production, or with respect to warping produced in the entire head plate by its own weight, and there is a possibility that the piezoelectric element may be damaged when partition grooves are formed along the direction orthogonal to the lengthwise direction of the head.

Japanese Patent Application Publication No. 2003-226007 proposes an actuator unit with a structure in which a plurality of layers of piezoelectric sheets having a size sufficient to span all of the pressure chambers are laminated, and in which internal electrodes are separated and individually formed for each pressure chamber in an inkjet head in which a plurality of pressure chambers are arrayed in two dimensions. However, this laminated structure has the drawback in that a sizable displacement cannot be obtained because the piezoelectric elements corresponding to the pressure chambers are not mechanically segmented, and there is also adjacent crosstalk. Moreover, since electrode patterns are used in which individual electrodes corresponding to each pressure chamber are preformed with the same pattern as the array pattern of the pressure chambers, there is the drawback in that it is difficult to control the position displacement produced by shrinkage (about 30%) when the piezoelectric element is made by calcining.

SUMMARY OF THE INVENTION

The present invention has been contrived in view of such circumstances, and an object thereof is to provide a droplet discharge head that can achieve a high-density arrangement of piezoelectric elements corresponding to the pressure chambers, improve mechanical strength with respect to warping in the lengthwise direction, and reduce crosstalk between the nozzles, and to provide a manufacturing method thereof.

In order to attain the aforementioned object, the present invention is directed to a droplet discharge head comprising: a plurality of nozzles which discharge droplets of liquid; a plurality of pressure chambers which are connected to the nozzles and filled with the liquid to be discharged through the nozzles; and a laminated piezoelectric body which has a plurality of active portions to impart pressure variation to the liquid inside the pressure chambers so as to cause the droplets to be discharged from the nozzles, respectively, wherein first linear grooves and second linear grooves which intersect each other at a prescribed non-orthogonal angle are formed in the laminated piezoelectric body, and the active portions of the laminated piezoelectric body are defined by the first and second linear grooves.

In accordance with the present invention, the laminated piezoelectric body is used as a device which causes the volume of the pressure chambers to vary, and the first and second linear grooves are formed in the laminated piezoelectric body in conformity with the shape or layout structure of the pressure chambers. The first and second linear grooves intersect at predetermined angles $\theta$ (where $\theta \neq 90°$) without being orthogonal to each other, the laminated piezoelectric body is partially segmented (in a state in which there is no complete separation) by these obliquely intersecting linear grooves, and the active portions are partitioned in units of the pressure chambers.

This structure allows pressure-generating devices (piezoelectric elements) corresponding to the pressure chambers to be formed in two dimensions, and crosstalk between neighboring nozzles to be reduced. The laminated piezoelectric body partially segmented with linear grooves has a unitary structure that is not entirely separated, and the handling during manufacture is simplified.

Preferably, in the droplet discharge head, a plurality of discharge elements are arrayed two-dimensionally in the droplet discharge head, each of the discharge elements being composed of the nozzle, the pressure chamber corresponding to the nozzle, and the active portion of the laminated piezoelectric body corresponding to the pressure chamber.

The present invention is an advantageous technology for constructing droplet discharge heads with a matrix array structure in which a plurality of discharge elements is arrayed in two dimensions.

Preferably, the first linear grooves are parallel to a lengthwise direction of the droplet discharge head, and the second linear grooves obliquely intersect with the first linear grooves. According to this, the second linear grooves are formed oblique to the lengthwise direction of the head, so in comparison with the case in which grooves are formed along the direction orthogonal to the lengthwise direction of the head, the mechanical strength with respect to warping in the lengthwise direction is high, and the laminated piezoelectric body can be prevented from cracking.

Preferably, the nozzles are arranged substantially along the second linear grooves. According to this, the relative positioning of the pressure chambers and the nozzles can be made uniform and manufacturing is made simple when constructing a head with a plurality of nozzles. Also, the nozzle pitch (pitch of projection nozzles projected to align in the lengthwise direction of the head) projected along the main scanning direction can be uniformly arrayed, and dots can be formed with a high-density in the main scanning direction of the two-dimensional array of nozzles.

Preferably, inactive portions are formed on peripheries of the active portions in the laminated piezoelectric body. According to this, crosstalk can be further reduced, head rigidity can be increased, and head warping can be inhibited by providing inactive portions, which are non-driven portions, to the area around the active portions corresponding to the pressure chambers. Also in this structure, the active portions and the inactive portions are mechanically linked at the base, so a support member or the like for restraining the end portion of the reverse side (end portion opposite from the surface that varies the volume of the pressure chamber) of the active portions is not required, the elastic displacement of the laminated piezoelectric body can be effectively applied to the joined surface, and a greater displacement volume can be obtained. A relatively large displacement can thereby be obtained with a low drive voltage.

Preferably, each of the active portions faces the corresponding pressure chamber on a side opposite from a droplet discharge direction; and each of the inactive portions faces a wall between the adjacent pressure chambers on a side opposite from the droplet discharge direction. According to this, crosstalk can be further reduced and greater head rigidity can be achieved with a configuration in which, of the surfaces (surfaces constituting the pressure chambers) forming volume spaces in the pressure chambers, the active portions of the piezoelectric body are disposed on the surface (surface facing the surface on which nozzle channels are formed, for example) in the direction opposite from the droplet discharge direction, and the inactive portions of the piezoelectric body are disposed and joined to the end surface in the direction opposite from the droplet discharge direction of the walls between the adjacent pressure chambers.

Preferably, the droplet discharge head further comprises: a channel-forming member in which the pressure chambers are formed; and a resin film with which the laminated piezoelectric body is attached to the channel-forming member. According to this, the amount of displacement can be increased and driving can be achieved with a lower voltage by an aspect in which a flexible resin film is used instead of a conventional vibration plate composed of metal, ceramic, or other plate material; one wall surface of the pressure chambers is composed of the resin film; and the channel-forming member and the piezoelectric body are joined together.

Preferably, the laminated piezoelectric body comprises laminated layers made of piezoelectric material, and internal electrodes disposed between the laminated layers, the internal electrodes being electrically connected with electrode materials embedded in through holes formed in the laminated piezoelectric body.

Preferably, the internal electrodes and the electrode material contain piezoelectric powder with a same composition as the piezoelectric material. According to this, the bonding characteristics of the interface between the piezoelectric layers and the electrodes can be improved, strength during machining can be maintained, and resistance to warping during driving can be improved by blending piezoelectric powder with the electrode material in a given composition.

Preferably, the droplet discharge head further comprises a ball grid array which leads out the internal electrodes from a side of the piezoelectric body opposite from a droplet discharge direction. According to this, electrodes can be brought out together from the reverse side of the piezoelectric body (surface on the side opposite from the surface where the body is joined to the member for forming the pressure chambers), and wiring for electrical connection is simplified.

The present invention is also directed to an inkjet recording apparatus, comprising: an inkjet recording head including the above-described droplet discharge head, wherein an image is recorded onto a recording medium by discharging ink droplets from the nozzles while the recording medium is relatively moved with respect to the inkjet recording head.

The present invention is also directed to a method of manufacturing a droplet discharge head, comprising: a laminated piezoelectric body fabrication step of laying a plurality of layers of piezoelectric sheets on which a common electrode pattern is formed over an area spanning a plurality of pressure chambers and piezoelectric sheets on which a drive electrode pattern is formed over an area spanning the pressure chambers, and calcining the laid sheets to fabricate a laminated piezoelectric body; a groove machining step of machining grooves in the laminated piezoelectric body fabricated in the laminated piezoelectric body fabrication step to form first linear grooves and second linear grooves which intersect each other at a prescribed non-orthogonal angle to define active portions of the laminated piezoelectric body corresponding to the pressure chambers with the first and second linear grooves; and a bonding step of bonding the laminated piezoelectric body with the machined grooves to a channel-forming member in which the plurality of pressure chambers are formed.

In accordance with the present invention, the piezoelectric active portions corresponding to the pressure chambers can be arranged in two dimensions with high density, and manufacturing is simplified in comparison with a structure in which an independent piezoelectric element for each pressure chamber is separately disposed. Also in the present invention, common electrode patterns and drive electrode patterns with an area that spans a plurality of pressure chambers are segmented into pressure chamber units by machining grooves after piezoelectric calcining, so the effects of displacement of the position of the electrodes due to shrinkage during piezoelectric calcining can be avoided in comparison with conventional methods in which a discrete electrode pattern is formed in advance for each pressure chamber, and the laminated piezoelectric body is calcined. Furthermore, the present invention is configured so that crosstalk is reduced by segmentation with grooves, and a greater displacement can be obtained for the piezoelectric active portions corresponding to the pressure chambers.

Preferably, the method of manufacturing the droplet discharge head further comprises: a hole machining step of forming through holes in prescribed positions of the piezoelectric sheets; and an electrode printing step of forming the common electrode pattern and the drive electrode pattern by a screen printing method on the piezoelectric sheets in which the through holes are formed, and embedding an electrode material in the through holes, wherein the piezoelectric sheets having undergone the electrode printing step are subjected to the laminated piezoelectric body fabrication step. According to this, the subsequent electrode-mounting step (plating, vapor deposition) is thereby made unnecessary, and manufacturing costs can be kept low.

In the present invention, the shape of the recording head is not particularly limited, and the head may be a shuttle-type recording head that prints while reciprocating in the direction that is substantially orthogonal to the feed direction of the recording medium, or a full-line recording head having nozzle rows in which a plurality of nozzles for discharging ink is arrayed across a length that corresponds to the entire width of the recording medium in a direction that is substantially orthogonal to the feed direction of the recording medium.

A "full-line recording head (droplet discharge head)" is normally disposed along the direction orthogonal to the relative feed direction of the recording medium, but also possible is an aspect in which the recording head is disposed along the oblique direction given a predetermined angle with respect to the direction orthogonal to the feed direction. The array form of the nozzles in the recording head is not limited to a single row array in the form of a line, but a matrix array composed of a plurality of rows is also possible. Also possible is an aspect in which a plurality of short-length recording head units having a row of nozzles that do not have lengths that correspond to the entire width of the recording medium is combined and the image-recording element rows are configured so as to correspond to the entire width of the recording medium, with these units acting as a whole.

The "recording medium" is a medium (an object that may be referred to as a print medium, image formation medium, recording medium, image receiving medium, or the like) on which images are recorded by the action of a recording head, and includes continuous paper, cut paper, seal paper, OHP sheets, and other resin sheets, as well as film, cloth, and various other media without regard to materials or shapes. In the present specification, the term "printing" expresses the concept of not only the formation of characters, but also the formation of images with a broad meaning that includes characters.

The term "conveyance device" includes an aspect in which the recording medium is conveyed with respect to a stationary (fixed) recording head, an aspect in which the recording head is moved with respect to a stationary recording medium, or an aspect in which both the recording head and the recording medium are moved.

According to the present invention, there is provided a structure in which grooves are machined in the laminated piezoelectric body, first and second linear grooves that intersect each other without being mutually orthogonal are formed, and active portions corresponding to the pressure chambers are segmented. The piezoelectric active portions can therefore be disposed with a high density, and handling during manufacturing is simplified. Also, mechanical strength is improved with respect to warping in the lengthwise direction of the piezoelectric body by an aspect in which grooves are formed in an oblique direction in relation to the direction orthogonal to the lengthwise direction of the head.

Crosstalk can be further reduced by an aspect in which non-driven inactive portions are provided around the periphery of the active portions of the piezoelectric body.

Preferred embodiments of the present invention are described below with reference to the attached diagrams.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 11A and 11B are diagrams used for describing the groove machining in the lengthwise direction of the laminated piezoelectric body, wherein FIG. 11A is a cross-sectional side view in the breadthways direction, and FIG. 11B is a plan view;

FIGS. 12A and 12B are diagrams used for describing the groove machining in the breadthways direction of the laminated piezoelectric body, wherein FIG. 12A is a cross-sectional side view in the breadthways direction, and FIG. 12B is a plan view;

FIGS. 13A and 13B are diagrams used for describing the mechanical strength in the print head of the present embodiment, wherein FIG. 13A is a plan view, and FIG. 13B is a side view;

FIGS. 14A and 14B are reference diagrams used for describing the mechanical strength in a print head obtained using a laminated piezoelectric body in which orthogonally intersecting slits in the form of a matrix are formed, wherein FIG. 14A is a plan view, and FIG. 14B is a side view.

DETAILED DESCRIPTION OF THE PREFERRED EMBODIMENTS

General Configuration of an Inkjet Recording Apparatus

Figure 1:
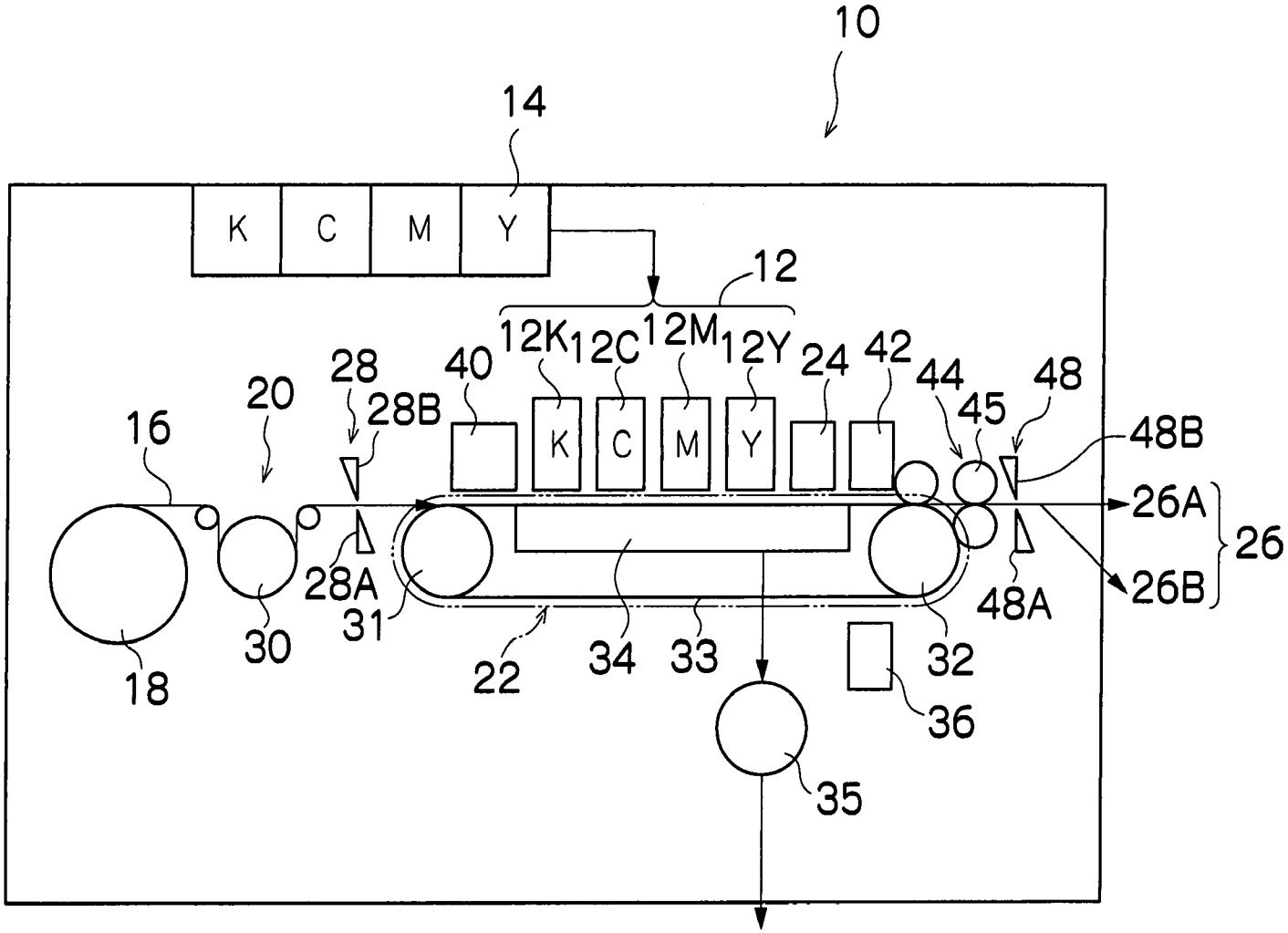
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 4) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
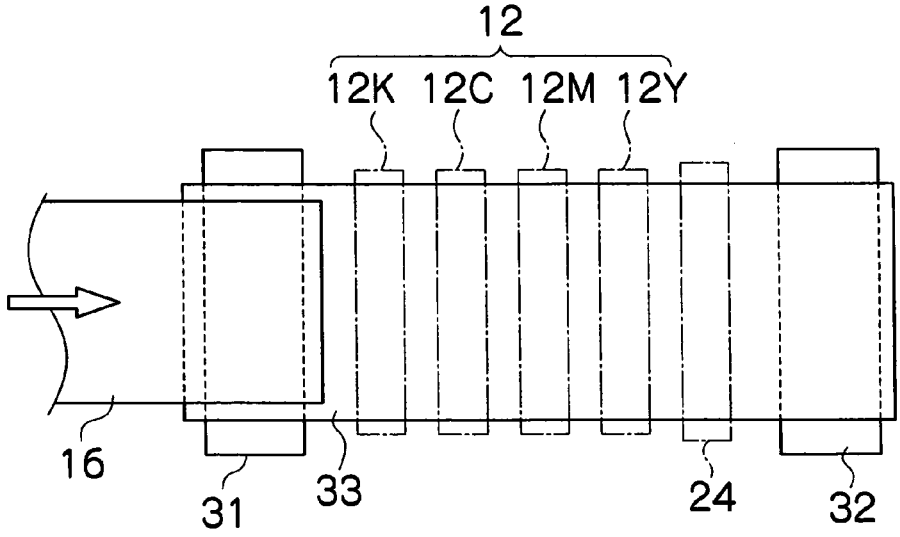
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor. The print determination unit 24 is configured with at least a line sensor or area sensor having rows of photoelectric transducing elements with a width that is greater than the ink-droplet ejection width (image recording width) of the print heads 12K, 12C, 12M, and 12Y.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

Figure 3:
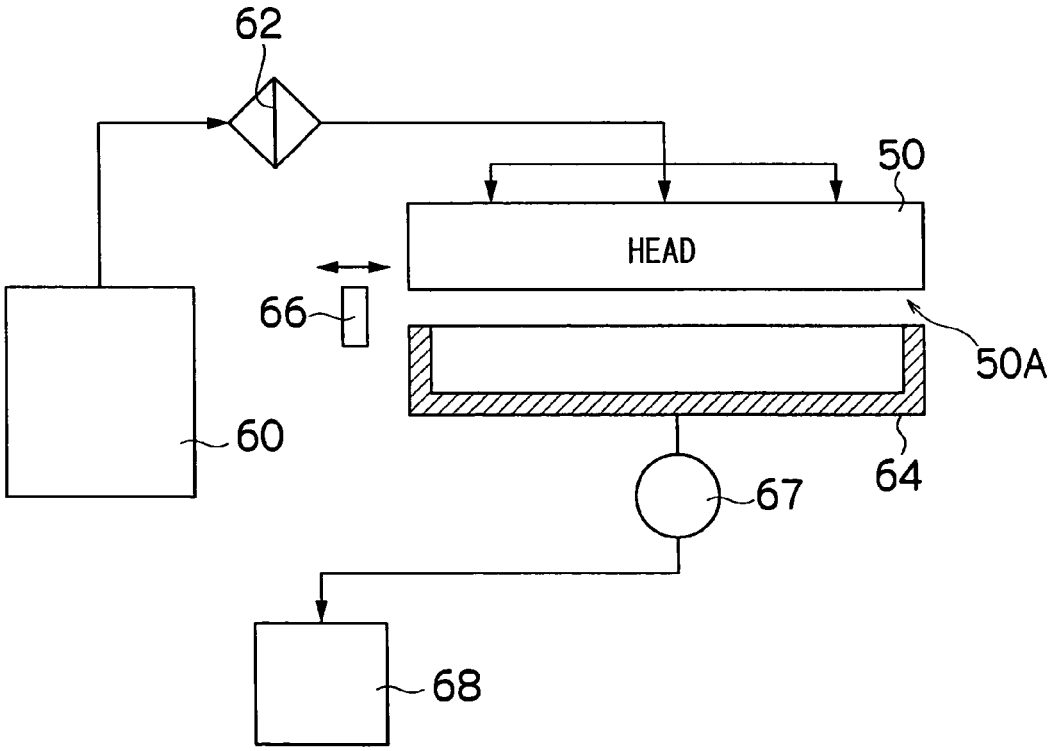
FIG. 3 is a schematic drawing showing a configuration of an ink supply system in the inkjet recording apparatus.

FIG. 3 is a schematic drawing showing the configuration of the ink supply system in the inkjet recording apparatus 10. The constructions for the respective colors are the same to each other, and a reference numeral 50 is hereinafter designated to any of the print heads 12K, 12C, 12M and 12Y.

An ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 3 is equivalent to the ink storing and loading unit 14 in FIG. 1 described above.

A filter 62 for removing foreign matters and bubbles is disposed between the ink supply tank 60 and the print head 50 as shown in FIG. 3. The filter mesh size in the filter 62 is preferably equivalent to or less than the diameter of the nozzle and commonly about 20 μm.

Although not shown in FIG. 3, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles, and a cleaning blade 66 as a device to clean the nozzle face 50A. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink discharge surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles evaporates and ink viscosity increases. In such a state, ink can no longer be discharged from the nozzle even if the discharge driving actuator is operated. Before reaching such a state the actuator is operated (in a viscosity range that allows discharge by the operation of the actuator), and the preliminary discharge is made toward the ink receptor to which the ink whose viscosity has increased in the vicinity of the nozzle is to be discharged. After the nozzle surface is cleaned by a wiper such as the cleaning blade 66 provided as the cleaning device for the nozzle face, a preliminary discharge is also carried out in order to prevent the foreign matter from becoming mixed inside the nozzles by the wiper sliding operation. The preliminary discharge is also referred to as "dummy discharge", "purge", "liquid discharge", and so on.

When bubbles have become intermixed in the nozzle or the pressure chamber, or when the ink viscosity inside the nozzle has increased over a certain level, ink can no longer be discharged by the preliminary discharge, and a suctioning action is carried out as follows.

More specifically, when bubbles have become intermixed in the ink inside the nozzle and the pressure chamber, ink can no longer be discharged from the nozzles even if the actuator is operated. Also, when the ink viscosity inside the nozzle has increased over a certain level, ink can no longer be discharged from the nozzle even if the actuator is operated. In these cases, a suctioning device to remove the ink inside the pressure chamber by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber, so that the amount of ink consumption is considerable. Therefore, a preferred aspect is one in which a preliminary discharge is performed when the increase in the viscosity of the ink is small. The cap 64 described with reference to FIG. 3 serves as the suctioning device and also as the ink receptacle for the preliminary discharge.

Description of Control System

Next, the control system in the inkjet recording apparatus 10 is described.

Figure 4:
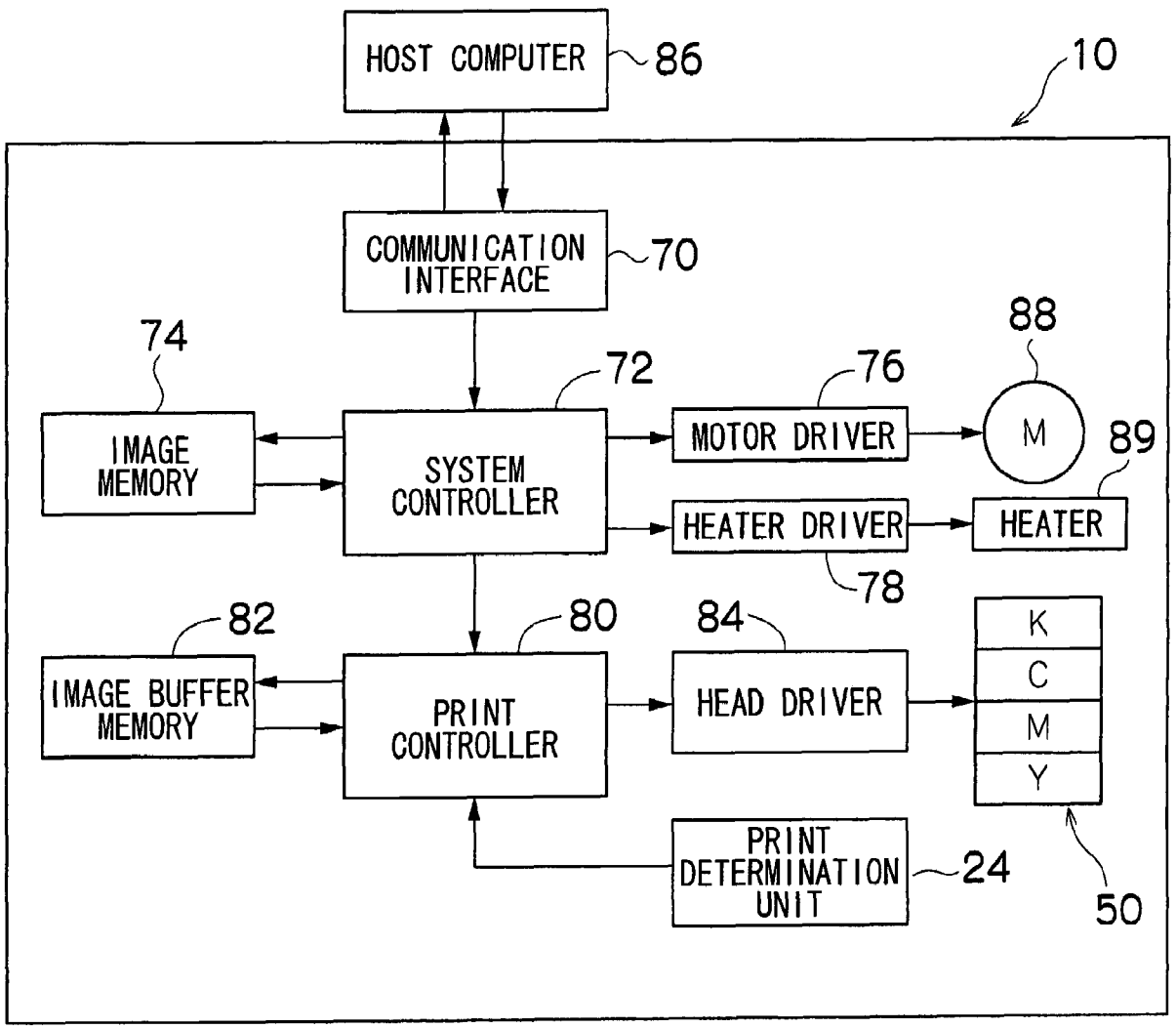
FIG. 4 is a principal block diagram showing the system composition of the ink-jet recording apparatus.

FIG. 4 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. Prescribed signal processing is carried out in the print control unit 80, and the discharge amount and the discharge timing of the ink droplets or the protective liquid from the respective print heads 50 are controlled via the head drier 84, on the basis of the image data. By this means, prescribed dot size, dot positions, or coating of protective liquid can be achieved.

The print controller 80 is provided with the image buffer memory 82; and image data, parameters, and other data are temporarily stored in the image buffer memory 82 when image data is processed in the print controller 80. The aspect shown in FIG. 4 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the discharge driving actuators for the print heads 12K, 12C, 12M and 12Y of the respective colors on the basis of the print data received from the print controller 80. A feedback control system for keeping the drive conditions for the print heads constant may be included in the head driver 84.

The image data to be printed is externally inputted through the communication interface 70, and is stored in the image memory 74. In this stage, the RGB image data is stored in the image memory 74. The image data stored in the image memory 74 is sent to the print controller 80 through the system controller 72, and is converted to the dot data for each ink color by a known dithering algorithm, random dithering algorithm or another technique in the print controller 80.

According to the dot data thus generated by the print controller 80, the print head 50 is driven, so that ink is ejected from the print head 50. An image is formed on the recording paper 16 by controlling the ink ejection from the print head 50 in synchronization with the conveyance velocity of the recording paper 16.

The print determination unit 24 is a block that includes the line sensor as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 80.

The print controller 80 makes various compensation with respect to the print head 50 as required on the basis of the information obtained from the print determination unit 24.

Structure of the Print Head

The structure of the print head 50 is described next.

Figure 5:
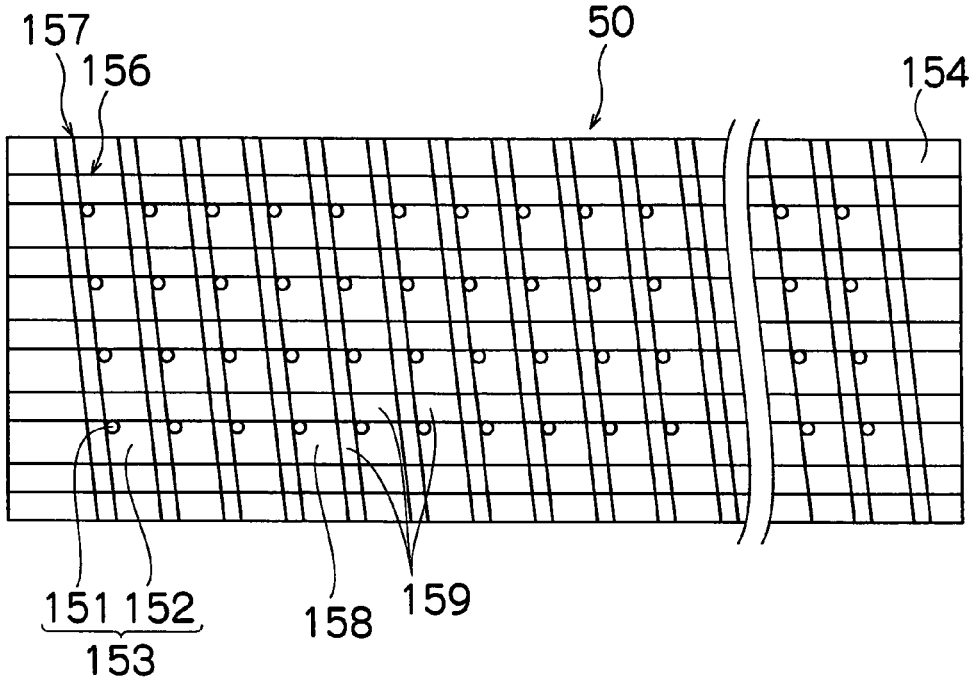
FIG. 5 is a perspective plan view of the print head viewed from the nozzle surface side.
Figure 6:
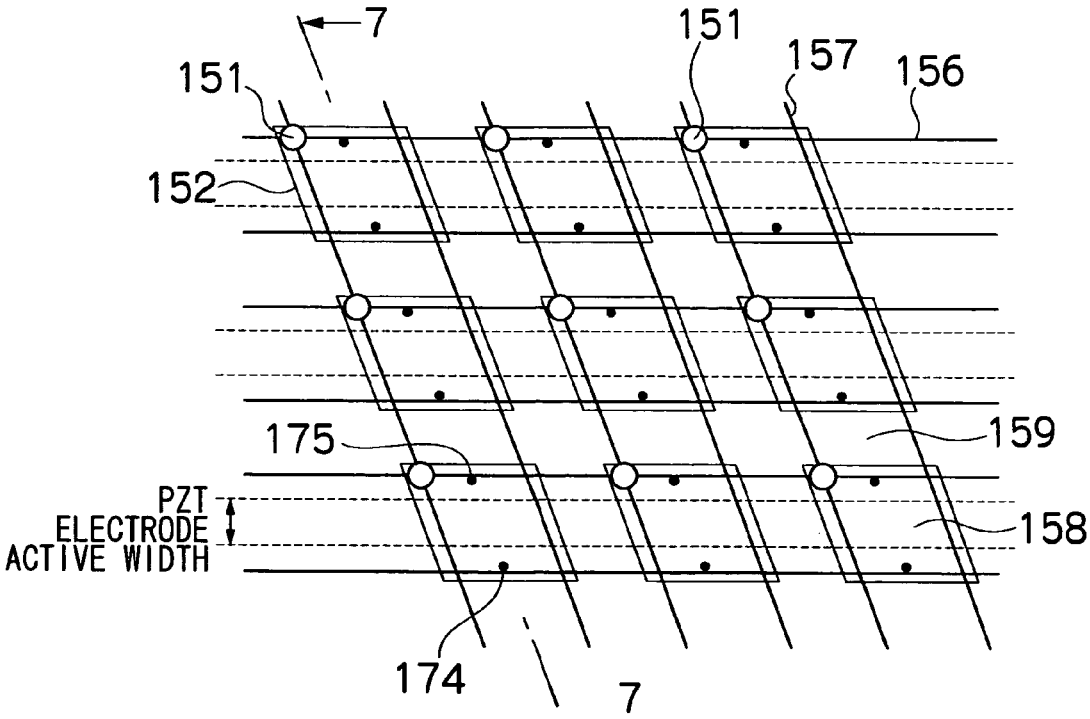
FIG. 6 is an enlarged view of the principal components of the print head shown in FIG. 5.
Figure 7:
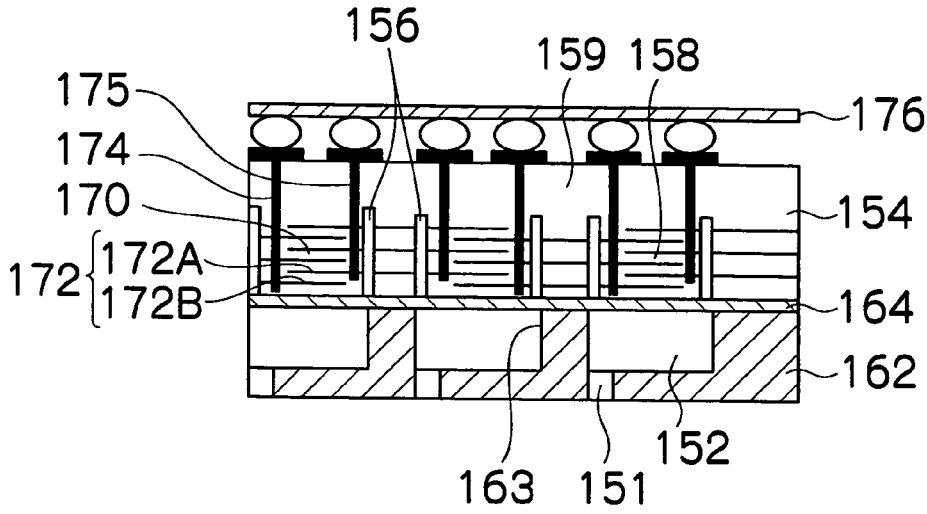
FIG. 7 is a projected cross-sectional view in which the cross section along line 7-7 in FIG. 6 is projected onto the plane orthogonal to the lengthwise direction of the head.
Figure 8:
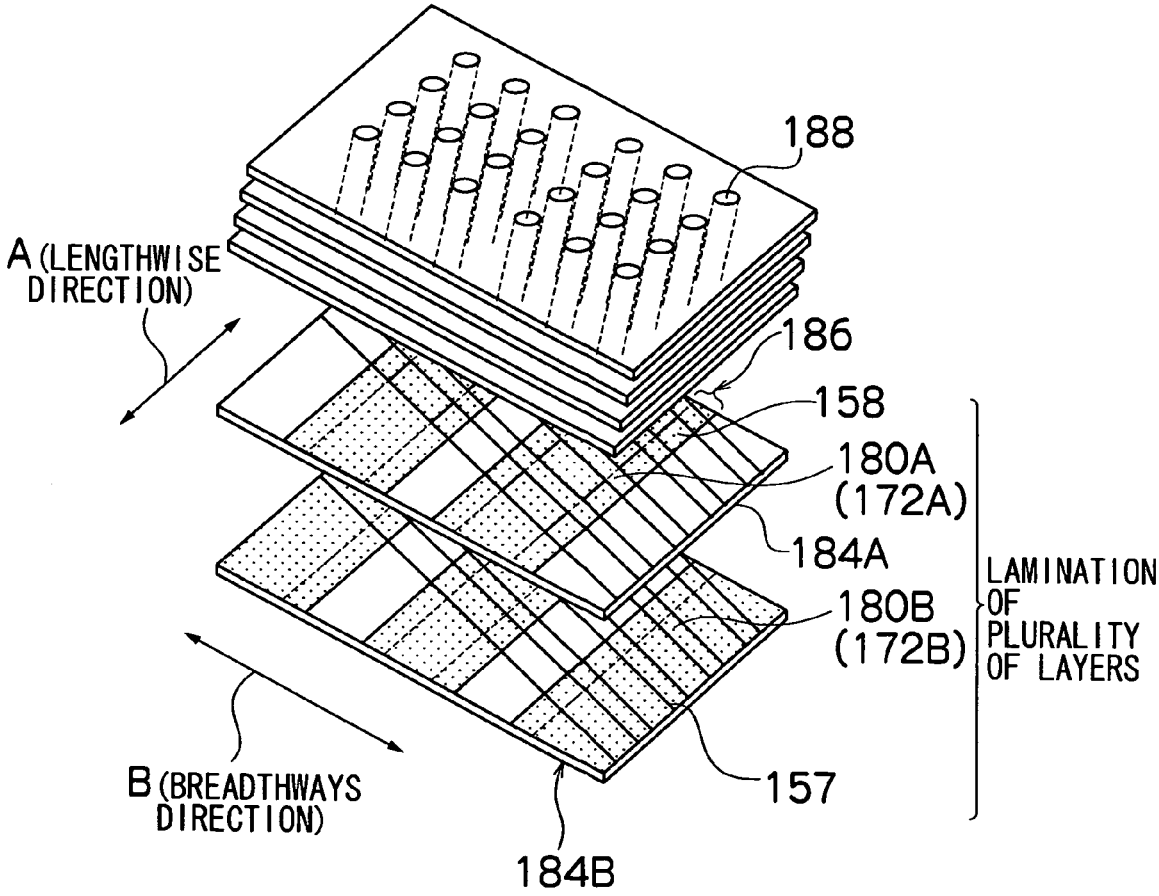
FIG. 8 is an exploded perspective view of the laminated piezoelectric body mounted on the print head of FIG. 5.

FIG. 5 is a perspective plan view of the print head 50 viewed from the nozzle surface 50A side; FIG. 6 is an enlarged view of the principal components in FIG. 5; FIG. 7 is a cross-sectional view (projected cross-sectional view in which the cross section along line 7-7 in FIG. 6 is projected onto the plane orthogonal to the lengthwise direction of the head); and FIG. 8 is an exploded perspective view of the laminated piezoelectric body, which is the actuator portion of the head in FIG. 5. In these diagrams, the reference numeral 151 is a nozzle for discharging ink droplets, reference numeral 152 is a pressure chamber, reference numeral 154 is a laminated piezoelectric body, and reference numerals 156 and 157 are slits (half-cut grooves) formed in the laminated piezoelectric body 154.

The print head 50 of the present embodiment has the structure of a matrix array in which discharge elements 153 composed of the nozzles 151 and the pressure chambers 152 corresponding to the nozzles 151 are arrayed in two dimensions with prescribed spacing in the lengthwise direction (the lateral direction in FIG. 5) and the breadthways direction (the vertical direction in FIG. 5) of the head. The pressure chambers 152 are substantially rhombic in planar shape (shape in a plan view), and are defined by pairs of sides that are parallel to the lengthwise direction of the print head 50, and by pairs of oblique sides that intersect the first pairs at non-orthogonal angles θ (θ≠90°). In the configuration of the pressure chamber 152, the nozzle 151 is disposed in one of the acute corners, and an ink supply port (not shown) is disposed in the other of the acute corners.

In accordance with this aspect, the relative arrangement of the pressure chambers and the nozzles can be made uniform, and manufacturing is simplified during production of a head having a plurality of nozzles. Also, the nozzle pitch projected along the main scanning direction (i.e., the pitch of projection nozzles projected to align in the lengthwise direction of the head) can be uniformed, and dots can be formed at a high density (i.e., at a small pitch) in the main scanning direction with the nozzles arrayed in two dimensions.

The piezoelectric body 154 for varying the volumes of the pressure chambers 152 is formed of a plurality of layers piezoelectric sheets laminated and calcined, of which size is sufficient to span all of the pressure chambers 152. The slits 156 and 157 are formed on the piezoelectric body 154. The slits 156 are parallel to the lengthwise direction of the print head 50 in conformity with the shape of the pressure chambers 152, and the slits 157 intersect the slits 156 at non-orthogonal angles θ. The slits 156 and 157 thereby define active portions 158 and inactive portions 159. The active portions 158 have a planar shape substantially matching the planar shape of the pressure chambers 152. The inactive portions 159 around the active portions 158 correspond to the wall portions between the pressure chambers 152.

As shown in FIG. 7, the active portions 158 of the piezoelectric body 154 segmented in a pectinate form by the slits 156 and 157 are positioned on the ceiling of the pressure chambers 152 formed in the channel-forming member 162; the inactive portions 159 are positioned in the upper surfaces of the wall portions 163 between the pressure chambers 152; and the piezoelectric body 154 composed of the active portions 158 and the inactive portions 159 is joined to the channel-forming member 162 by way of an adhesive film 164 made of resin (e.g., polyimide (PI), polyethyleneterephtalate (PET), dry film, or the like) (hereinafter referred to as a resin film).

A plurality of channel plates obtained by forming holes and grooves by etching, pressing, or the like in stainless steel (SUS) plates or other thin plate material, for example, are joined by lamination to fabricate the channel-forming member 162. In addition to the nozzles 151 and the pressure chambers 152, the common flow channels (not shown), the separate supply channels for linking the common flow channels and the pressure chambers, and other components are formed in the channel-forming member 162 in order to feed ink to the pressure chambers 152.

The resin film 164 may be one in which an adhesive is applied to both surfaces of the substrate composed of resin or other material, and may be a sheet composed of an adhesive as such. By using a thermosetting adhesive, the film may be cured and thereafter made to function as a vibration plate constituting the ceiling surface of the pressure chambers 152.

The piezoelectric body 154 has a structure in which piezoelectric material layers 170 and internal electrodes 172 are alternately overlaid, as shown in FIG. 7. The internal electrodes 172 are alternately disposed so that the common electrodes 172A connected to ground, and the drive electrodes 172B to which drive voltage is applied lie on both sides of the piezoelectric material layers 170. Electrode active areas are formed by the overlapping areas of the drive electrodes 172B and common electrodes 172A disposed in different layers.

The common electrodes 172A in different layers are electrically interconnected by electrode materials (electroconductive materials) embedded in through holes 174 formed in the laminated piezoelectric body 154, and the drive electrodes 172B in different layers are electrically interconnected by electrode materials (electroconductive materials) embedded in through holes 175 formed in the laminated piezoelectric body 154. The common electrodes 1 72A and the drive electrodes 1 72B are externally brought out together in a ball grid array (BGA) 176 from the reverse side of the piezoelectric body 154. Powder with the same composition as the piezoelectric material of a given composition is preferably blended with the electrode materials of the internal electrodes 172 and the electrode materials of embedded in the through holes 174 and 175 to improve bonding with the piezoelectric layer interface.

By applying drive voltage to the active portions 158 of the piezoelectric body 154 via the ball grid array 176 in the print head 50 with the above structure, the active portions 158 are elastically deformed in the laminating direction, the volume of the pressure chambers 152 is varied in association with the displacement thereof to pressurize the ink in the pressure chambers 152, and ink is discharged from the nozzles 151. When ink is discharged, new ink is fed to the pressure chambers 152 from the common channel (not shown) through the ink supply ports.

FIG. 8 is an exploded perspective view of the laminated piezoelectric body 154. The arrow A in FIG. 8 indicates the lengthwise direction of the print head 50, and the arrow B orthogonal thereto indicates the breadthways direction of the print head 50. The piezoelectric laminated body 154 is configured by laminating a plurality of piezoelectric sheets 184A on which a plurality of stripe-shaped electrode areas (hereinafter referred to as common electrode patterns) 180A are formed as the common electrodes 172A, and piezoelectric sheets 184B on which a plurality of stripe-shaped electrode areas (hereinafter referred to as drive electrode patterns) 180B are formed as the drive electrodes 172B. The lengthwise direction is not affected by shrinkage during calcining because the active width is determined by the machining accuracy of the slits 157. In the lengthwise direction, on the other hand, the electrode patterns 180A and 180B are formed with consideration for shrinkage during calcining.

The active portions 158 are defined by segmentation in which the overlapping area 186 of the common electrode patterns 180A and the drive electrode patterns 180B are segmented by the slits 157. In FIG. 8, the reference numeral 188 indicates an electrode embedded in the through hole 174 or 175. The active portions 158 are independently drivable areas.

Next, the manufacturing method of the print head is described.

Figure 9:
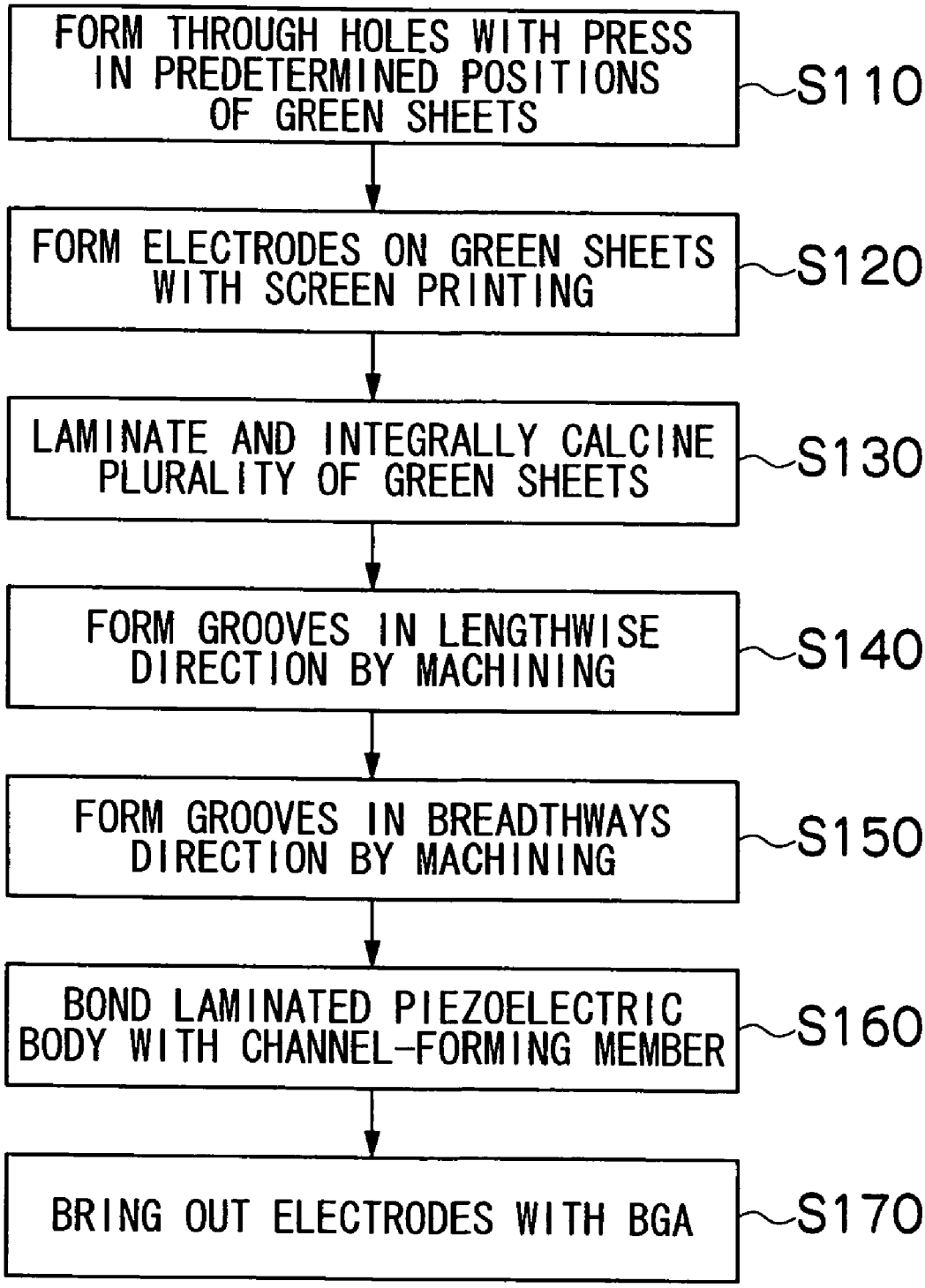
FIG. 9 is a flowchart showing the procedural steps for manufacturing the print head.

FIG. 9 is a flowchart showing the procedural steps for manufacturing the print head. First, through holes 174 and 175 are formed with a press in prescribed positions of green sheets (step S110). The patterns of the internal electrodes 172 are formed by screen-printing on the green sheets provided with the through holes 174 and 175 (step S120).

Figures 10A, 10B:
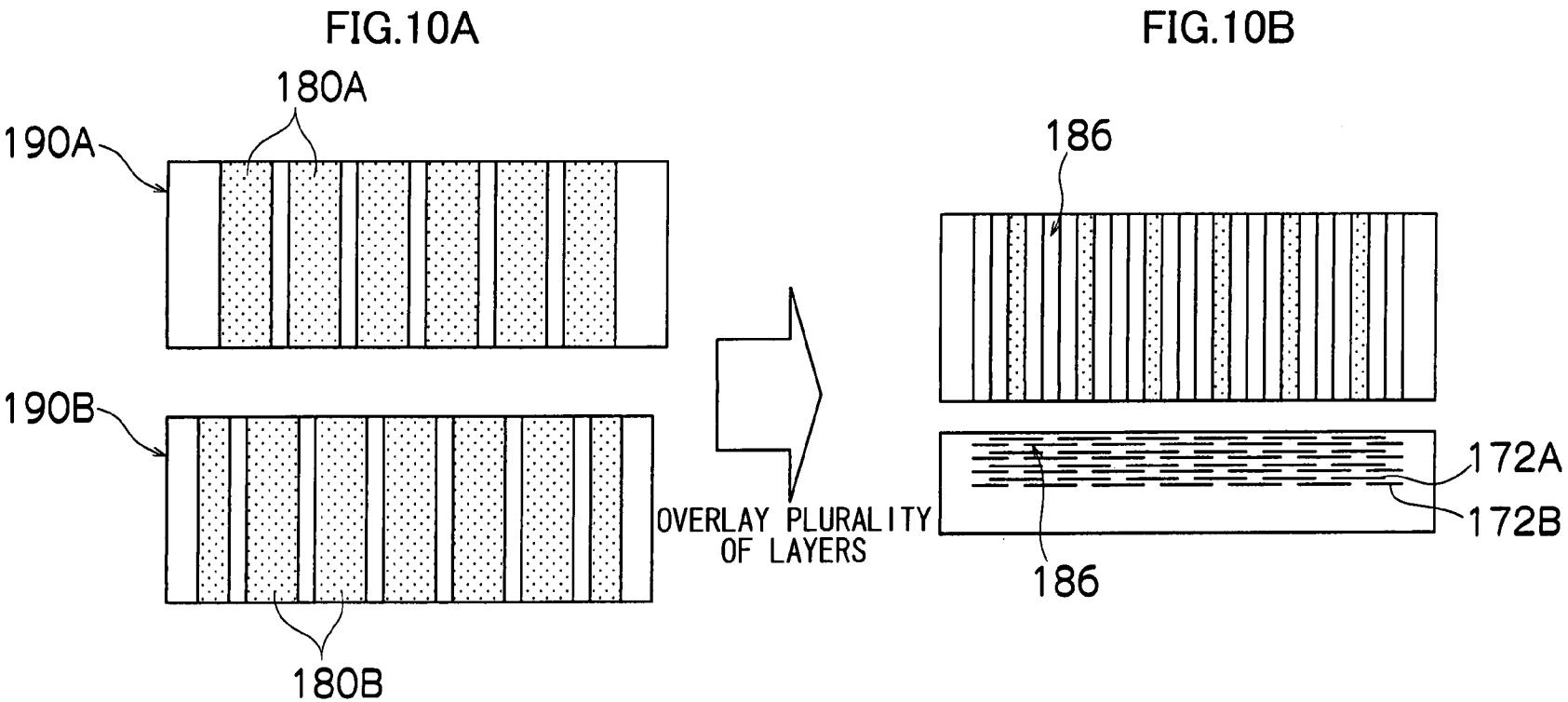
FIGS. 10A and 10B are diagrams used for describing the steps for laminating the green sheets.
Figures 11A, 11B:
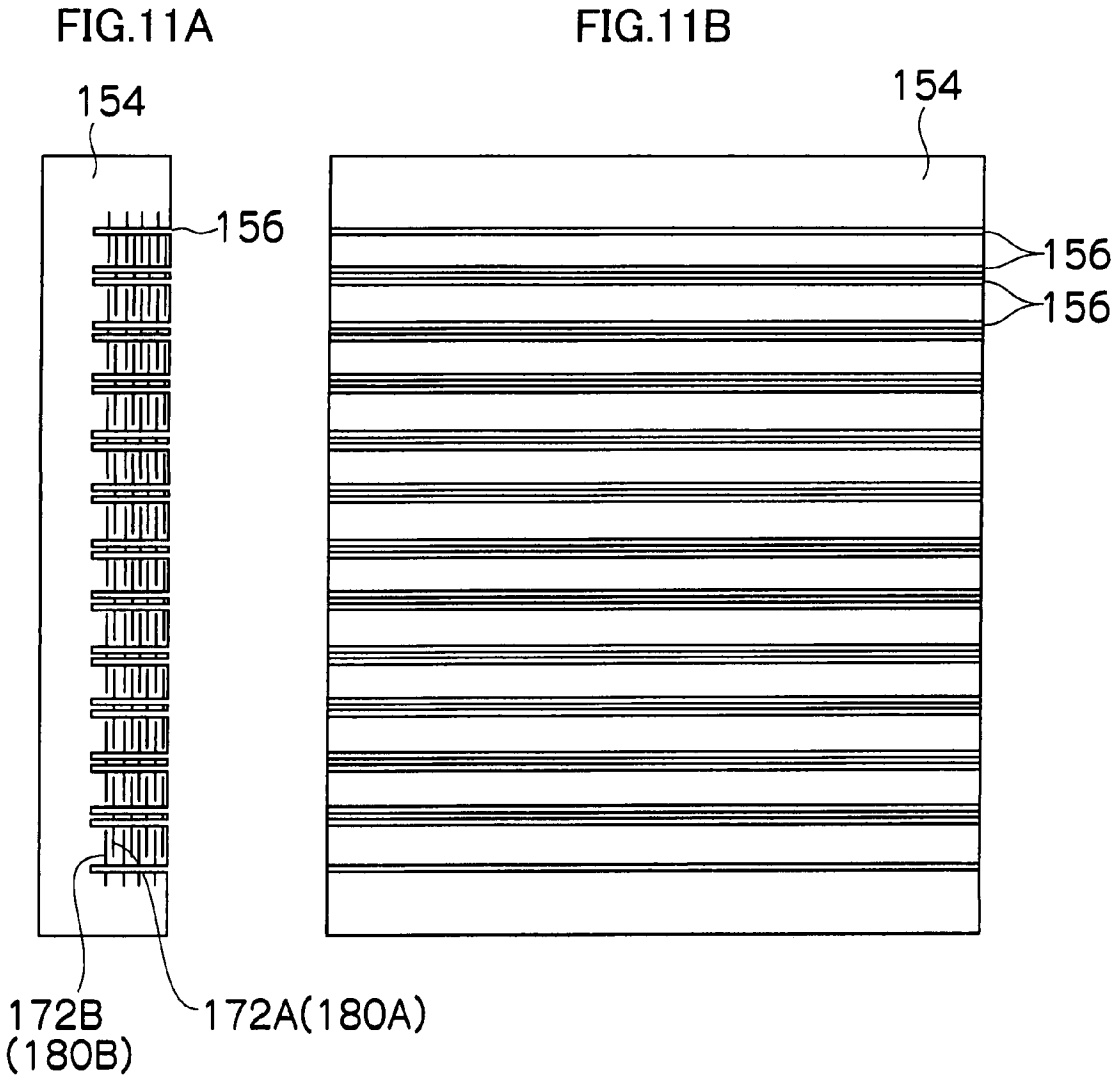

At this time, as shown in FIG. 10A, green sheets 190A with imprinted common electrode patterns 180A, and green sheets 190B with imprinted drive electrodes 180B are formed, and a plurality of these are alternately laminated (refer to FIG.

10B). The lateral direction in FIGS. 10A and 10B corresponds to the breadthways direction of the head. A plurality of rows of strip-shaped electrode areas 180A and 180B are printed and formed parallel along the lengthwise direction of the head with fixed spacing in the breadthways direction of the head.

During electrode screen printing, electrode material is allowed to flow into the through holes 174 and 175 by applying electrode material paste in also the hole portions of the through holes 174 and 175. When the electrode material cannot be adequately filled into the through holes 174 and 175 by printing, a step in which electrode material is injected into the through holes 174 and 175 with a dispenser or other instrument is added after laminating the green sheets 190A and 190B.

The superposed areas (the overlapping portions 186) of the common electrode patterns 180A and the drive electrode patterns 180B that are disposed in different layers by laminating a plurality of green sheets 190A and 190B in an alternating fashion are ranges in which the electrode active portions can be obtained. Also, green sheets without internal electrodes are overlaid on the side from which electrodes are brought out (reverse side). This laminated portion without internal electrodes is the portion corresponding to the base portion (portion integrally connecting the segmented portions to form the laminated piezoelectric body 154) that is not segmented by machining grooves described below.

The product of laminating a plurality of green sheets 190A and 190B as shown in FIG. 10B is calcined as a single unit to obtain a laminated piezoelectric body 154 (step S130 in FIG. 9).

Then, grooves are machined with a dicing saw in the laminated piezoelectric body 154 thus obtained (steps S140 to S150).

Figure 12B:
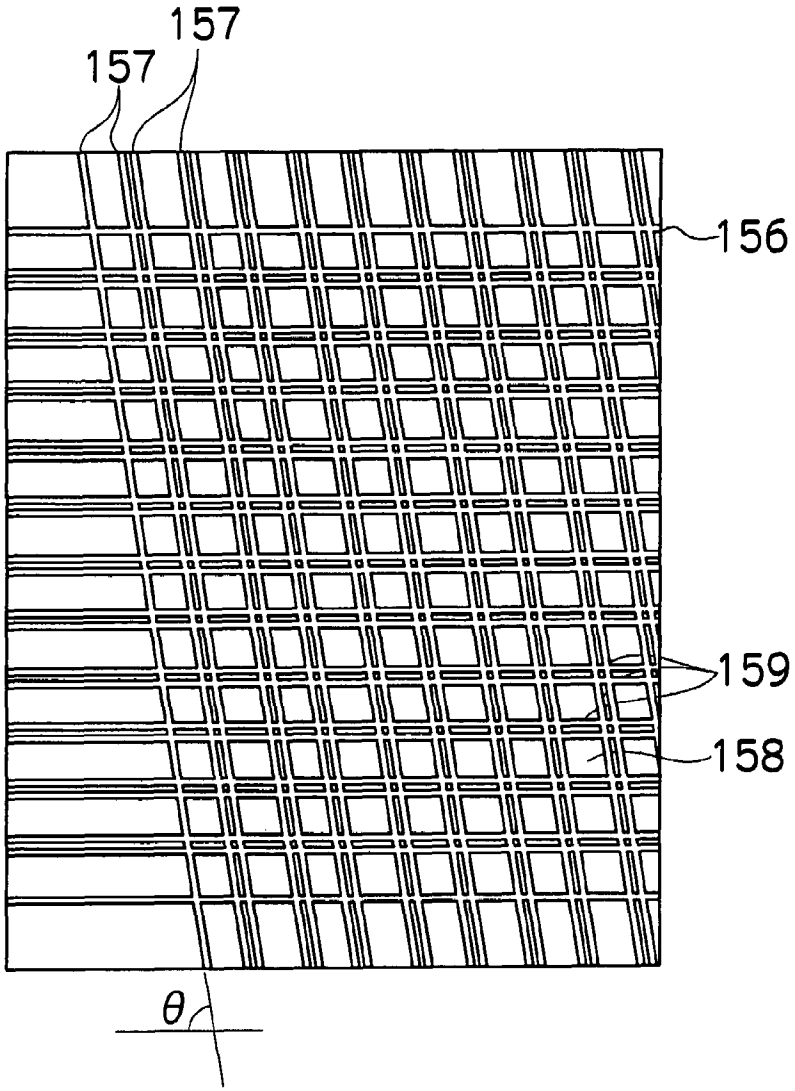
Figure 12A:
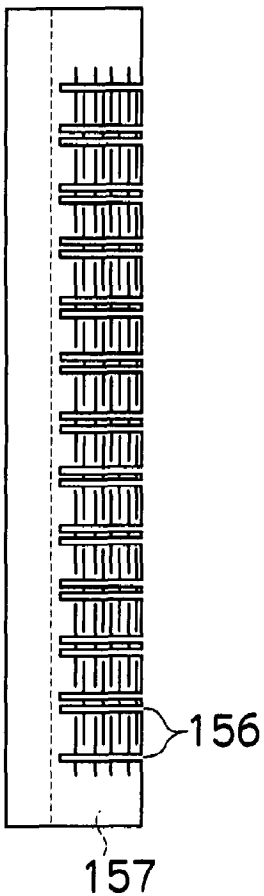

First, linear slits 156 are formed parallel to the lengthwise direction of the laminated piezoelectric body 154, as shown in FIGS. 1A and 1B (step S140 in FIG. 9). Next, oblique slits 157 with angles θ in the breadthways direction of the laminated piezoelectric body 154 are formed, as shown in FIGS. 12A and 12B (step S150 in FIG. 9). The slits 157 in the breadthways direction intersect the slits 156 in the lengthwise direction at a non-orthogonal angle θ (θ≠90°), as shown in FIG. 12B.

The laminated piezoelectric body 154 and the internal electrodes 172 are partially segmented by the slits 156 and 157, and the active portions 158, of which shapes conform to the pressure chambers 152, and the inactive portions 159 on the periphery thereof are formed.

The piezoelectric body 154 thus obtained is bonded to the channel-forming member 162 by way of the resin film 164, as shown in FIG. 7 (step S160 in FIG. 9), and the print head 50 is finished by bringing out electrodes from the reverse side with the ball grid array (step S170).

The method of bringing out the electrodes is not particularly limited to an aspect in which the electrode materials are embedded in the through holes 174 and 175 as described above. Also possible is an aspect in which electrodes are brought out with electrolytic plating or other method on the side of the laminated piezoelectric body, for example.

In the above-described embodiment, the resin film 164 is used as the vibration plate, but also possible is an aspect in which a vibration plate composed of metal or ceramic is used. In the implementation of the present invention, it is sufficient that the ink and piezoelectric body are separated, so that a resin film or other insulating material with low rigidity is adequate. Displacement of the piezoelectric body can be effectively transmitted to the pressure chambers, and the amount of displacement can be increased by using a material with low rigidity in the displacement portion that varies the volume of the pressure chamber.

Furthermore, the print head 50 in the present embodiment has a structure in which the active portions 158 and the inactive portions 159 segmented by the slits 156 and 157 are mechanically connected to each other in the base portion (structure in which the slits 156 and 157 are formed with some of the thickness of the base portion remaining), so that elastic displacement (displacement in the d33 direction) of the active portions 158 can be effectively applied in the direction of the pressure chambers 152, and a greater displacement volume can be obtained. A relatively large displacement can thereby be obtained with a low drive voltage.

Figure 13A:
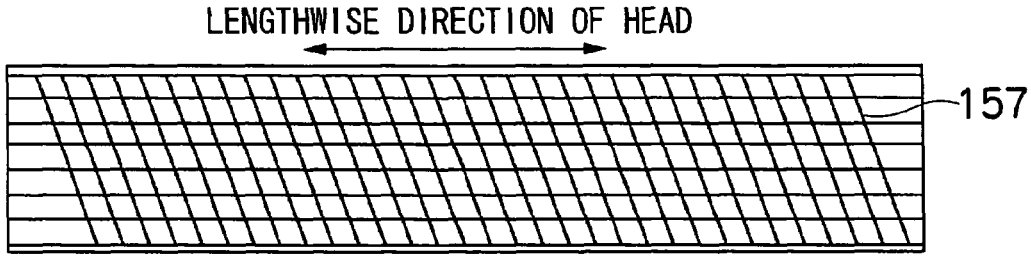
Figure 13B:
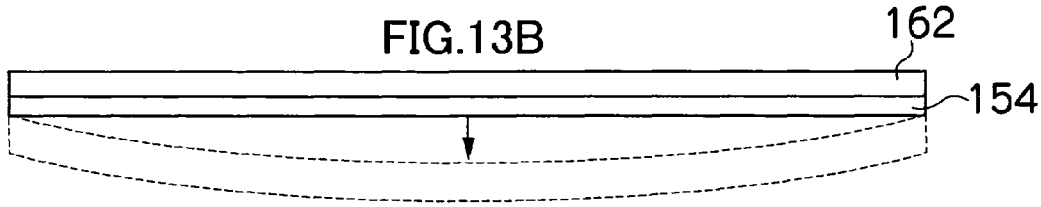

In accordance with the print head 50 of the present embodiment, the slits 157 are obliquely formed with respect to the breadthways direction of the print head 50 as shown in FIG. 13A. Hence, there are advantages in that the mechanical strength is high with respect to warping produced by its own weight and with respect to stress during bonding and the product is impervious to damage as shown in FIG. 13B. Therefore, it is possible to extend the length a single piece of laminated piezoelectric body.

Figure 14A:
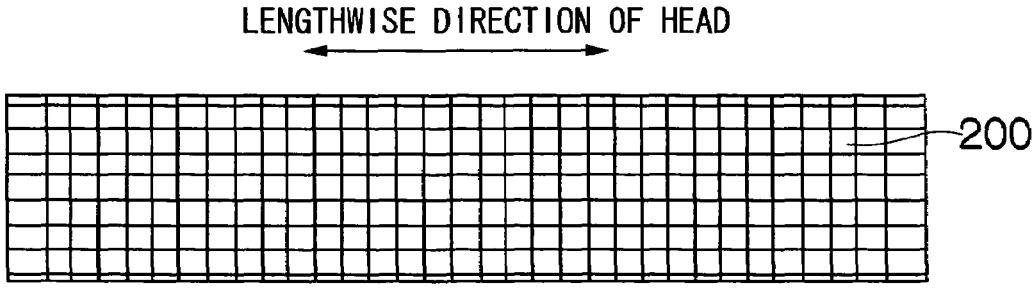
Figure 14B:
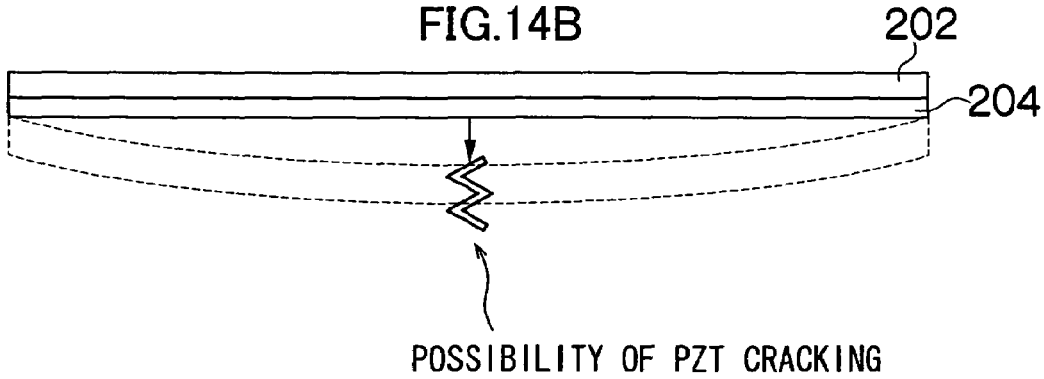

In contrast, assuming that slits 200 are formed perpendicular to the lengthwise direction of the head as shown in FIG. 14A, there is a possibility that the mechanical strength may be poor with respect to stress generated by bonding or by heat applied during the production, or with respect to warping produced in the entire head plate 202 by its own weight, and that the piezoelectric element plates 204 may be damaged as shown in FIG. 14B.

Modified Embodiment

Figure 15:
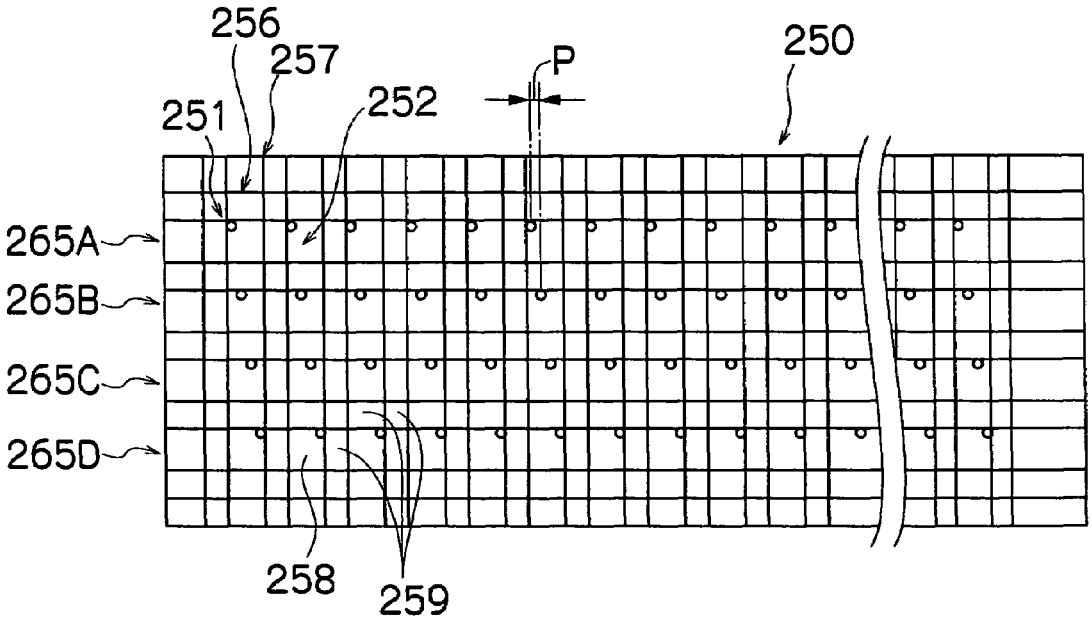
FIG. 15 is a perspective plan view of a print head according to another embodiment of the present invention viewed from the nozzle surface side.

FIG. 15 shows another embodiment of the present invention. The print head 250 shown in FIG. 15 may be used in lieu of the print head 50 described in FIG. 5. The internal structure thereof is substantially the same as the embodiment described in FIGS. 5 to 8, and the head is manufactured with the same method described in FIGS. 9 to 12B.

The print head 250 shown in FIG. 15 is configured so that a plurality of pressure chambers 252 have a substantially square planar shape, and the pressure chambers 252 are formed into a matrix with a two-dimensional array whose rows are vertically and horizontally orthogonal in the lengthwise and breadthways directions of the print head 250. Slits 256 and 257 are formed in the laminated piezoelectric body 254 in association with the shape and array configuration of the pressure chambers 252. The slits 256 are formed parallel to the lengthwise direction of the print head 250, and the slits 257 are formed parallel to the breadthways direction (so as to vertically intersect with the slits 256). The active portions 258 and the inactive portions 259 on the periphery thereof are partitioned in units of pressure chambers by these slits 256 and 257.

Increased displacement and reduced crosstalk can be achieved with the active portions 258 segmented in pectinate form by the slits 256 and 257. Also, crosstalk can be further reduced, the rigidity of the print head 250 can be improved, and warping of the head can be prevented by provision of inactive portions 259 that are associated with the wall portions of the pressure chambers 252. Furthermore, the displacement of the active portions 258 can be effectively applied in the pressure direction of the pressure chambers 252 because the active portions 258 are integrally connected with the inactive portions 259 at the base portion.

The formation positions of the nozzles 251 in the pressure chambers 252 are shifted in the same direction with a fixed pitch P for each row along the lengthwise direction of the pressure chamber array, as shown in FIG. 15. In FIG. 15, the nozzles 251 of the pressure chambers 252 aligned with the first pressure chamber row 265A, which is one of the four pressure chamber rows 265A to 265D aligned in the lengthwise direction of the head, are formed in the upper left-hand corner of the pressure chambers 252.

The nozzles 251 of the pressure chambers 252 aligned with the second row of pressure chambers 265B are formed in positions that are offset from the nozzle positions of the first row by an amount equal to the pitch P in the lengthwise direction of the head. In the same manner, the third and fourth rows are also configured with offset positions of the nozzles 251. The fourth row (last row) is configured so that the nozzles 251 are formed in the upper right-hand corner of the pressure chambers 252 as shown in FIG. 15.

In accordance with this configuration, the array spacing of the nozzles 251 projected so as to align in the lengthwise direction of the head has a pitch P, and a high-density nozzle configuration can be formed in the lengthwise direction of the head.

Described in the above embodiments is an inkjet recording apparatus that uses a page-wide full-line head having a row of nozzles with a length corresponding to the entire width of the recording medium, but the applicable scope of the present invention is not limited to this option alone, and the present invention may also be applied to an inkjet recording device that uses a shuttle head for recording images as the short recording head moves in a reciprocating fashion.

An inkjet recording apparatus has been described as an embodiment of an image formation apparatus, but the range of applicability of the present invention is not limited thereby. For example, the droplet discharge head of the present invention may also be applied to photographic image formation apparatuses for applying developing solution in a non-contact manner to photographic paper. The applicable scope of the present invention is not limited to image formation apparatuses and extends to application apparatuses and various other apparatuses in which a treatment solution or other solution is applied to a medium using a droplet discharge head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet discharge head, comprising:

a plurality of nozzles which discharge droplets of liquid;

a plurality of pressure chambers which are connected to the nozzles and filled with the liquid to be discharged through the nozzles; and a laminated piezoelectric body which has a plurality of active portions to impart pressure variation to the liquid inside the pressure chambers so as to cause the droplets to be discharged from the nozzles, respectively, wherein first linear grooves and second linear grooves which intersect each other at a substantially orthogonal angle are formed in the laminated piezoelectric body, and the active portions of the laminated piezoelectric body are defined by the first and second linear grooves, wherein the plurality of pressure chambers have a substantially same shape as the active portions, and wherein the plurality of nozzles corresponding to the plurality of pressure chambers are arranged in such a manner that, with respect to each of pressure chamber rows parallel to the first linear grooves, the nozzles corresponding to each of the pressure chamber rows parallel to the first linear grooves are shifted in a direction of each of the pressure chamber rows.

2. The droplet discharge head as defined in claim 1, wherein the first linear grooves are parallel to a lengthwise direction of the droplet discharge head.

3. The droplet discharge head as defined in claim 1, wherein the nozzles are arranged an oblique direction with respect to the second linear grooves.

4. The droplet discharge head as defined in claim 1, wherein inactive portions are formed on peripheries of the active portions in the laminated piezoelectric body.

5. The droplet discharge head as defined in claim 4, wherein:

each of the active portions faces the corresponding pressure chamber on a side opposite from a droplet discharge direction; and each of the inactive portions faces a wall between the adjacent pressure chambers on a side opposite from the droplet discharge direction.

6. The droplet discharge head as defined in claim 1 further comprising:

a channel-forming member in which the pressure chambers are formed; and a resin film with which the laminated piezoelectric body is attached to the channel-forming member.

7. The droplet discharge head as defined in claim 1 further comprising a ball grid array which leads out the internal electrodes from a side of the piezoelectric body opposite from a droplet discharge direction.

8. An inkjet recording apparatus, comprising:

an inkjet recording head including the droplet discharge head as defined in claim 1 wherein an image is recorded onto a recording medium by discharging ink droplets from the nozzles while the recording medium is relatively moved with respect to the inkjet recording head.

9. The droplet discharge head as defined in claim 1, wherein a plurality of discharge elements are arrayed two-dimensionally in the droplet discharge head, each of the discharge elements being composed of the nozzle, the pressure chamber corresponding to the nozzle, and the active portion of the laminated piezoelectric body corresponding to the pressure chamber.

10. The droplet discharge head as defined in claim 1, wherein the laminated piezoelectric body comprises laminated layers made of piezoelectric material, and internal electrodes disposed between the laminated layers, the internal electrodes being electrically connected with electrode materials embedded in through holes formed in the laminated piezoelectric body.

11. The droplet discharge head as defined in claim 10, wherein the internal electrodes and the electrode material contain piezoelectric powder with a same composition as the piezoelectric material.

12. A droplet discharge head, comprising:

a plurality of nozzles which discharge droplets of liquid;

a plurality of pressure chambers which are connected to the nozzles and filled with the liquid to be discharged through the nozzles; and a laminated piezoelectric body which has a plurality of active portions to impart pressure variation to the liquid inside the pressure chambers so as to cause the droplets to be discharged from the nozzles, respectively, and a plurality of inactive portions that are located around the plurality of active portions, wherein first linear grooves and second linear grooves which intersect each other at a substantially orthogonal angle are formed in the laminated piezoelectric body in such a manner that a base part of the laminated piezoelectric body exists and the first linear grooves and the second linear grooves are opened toward the plurality of pressure chambers, and the plurality of active portions and the plurality of inactive portions of the laminated piezoelectric body are defined by the first and second linear grooves in such a manner that each of the plurality of active portions has a square shape, wherein the plurality of pressure chambers have a substantially same shape as the active portions, and wherein the plurality of nozzles corresponding to the plurality of pressure chambers are arranged in such a manner that, with respect to each of pressure chamber rows parallel to the first linear grooves, the nozzles corresponding to each of the pressure chamber rows parallel to the first linear grooves are shifted in a direction of each of the pressure chamber rows, and wherein the plurality of active portions are respectively located in surfaces of the plurality of pressure chambers which are opposite from a liquid droplet discharge direction, and the plurality of inactive portions are respectively located in surfaces of walls between the plurality of pressure chambers which are opposite from the liquid droplet discharge direction.

* * * * *